US005546838A

United States Patent [19]

Longwell

[11] Patent Number: 5,546,838

[45] Date of Patent: Aug. 20, 1996

[54] NOTCH TIMING DEVICE AND METHOD FOR CARD SLITTING MACHINE

[75] Inventor: Michael V. Longwell, San Marcos, Calif.

[73] Assignee: The Upper Deck Company, Carlsbad, Calif.

[21] Appl. No.: 431,190

[22] Filed: Apr. 28, 1995

[51] Int. Cl.[6] ..... B26D 5/20; B26D 1/56

[52] U.S. Cl. ..... 83/37; 83/76; 83/298; 83/332; 83/734

[58] Field of Search ..... 83/298, 37, 500, 83/358, 502, 503, 436, 734, 76, 299, 311, 332; 474/111, 136, 138

[56] References Cited

U.S. PATENT DOCUMENTS

| | | | |
|---|---|---|---|
| 2,136,001 | 11/1938 | Carter | 83/76 |
| 2,815,077 | 12/1957 | Pechy | 164/60 |
| 3,144,797 | 8/1964 | Pitner | 83/87 |
| 3,173,325 | 3/1965 | Warren et al. | 83/499 |
| 3,173,326 | 3/1965 | Gulliksen et al. | 83/501 |
| 3,185,006 | 5/1965 | Mercer et al. | 83/33 |
| 3,255,651 | 6/1966 | Huck | 83/76 |
| 3,276,647 | 10/1966 | Lewis, Jr. et al. | 83/76 |
| 3,286,574 | 11/1966 | Durand | 83/501 |
| 3,757,625 | 9/1973 | Pfenning et al. | 83/404.1 |
| 3,861,123 | 1/1975 | Eburn, Jr. et al. | 53/372 |
| 4,028,973 | 6/1977 | Bogdanski et al. | 83/169 |
| 4,405,121 | 9/1983 | Hill | 270/58 |
| 5,058,475 | 10/1991 | Tidland et al. | 83/481 |
| 5,146,827 | 9/1992 | Komatsu et al. | 83/482 |

*Primary Examiner*—Kenneth E. Peterson
*Assistant Examiner*—Sean A. Pryor
*Attorney, Agent, or Firm*—Cahill, Sutton & Thomas P.L.C.

[57] ABSTRACT

A slitting machine including a first slitting stage for producing a plurality of interrupted cut slits in an advancing sheet having a leading edge and a trailing edge includes a drive pulley, a driven pulley, and a belt engaging the drive pulley and the driven pulley to provide a power path and a return path between the drive pulley and the driven pulley. The slitting machine also includes a mechanism translating rotation of the driven pulley to drive an upper slitting assembly and notched blades of a lower slitting assembly in synchronization with the advancing of the sheet by a sheet feeder. A moveable idle pulley engages a portion of the belt in the power path, and an adjustment mechanism controls the moveable idle pulley to adjust the length of the power path, thereby varying the locations of the notches of the lower blades relative to the sheet being advanced, and thereby allows adjustment of the width of the margins at the leading and trailing edges of the advancing sheet to compensate for slippage of the advancing sheet due to variations in its thickness, type of material, and/or surface finish.

15 Claims, 2 Drawing Sheets

NOTCH TIMING DEVICE AND METHOD FOR CARD SLITTING MACHINE

BACKGROUND OF THE INVENTION

The invention relates to an improvement to a commercially available sport card slitting machine known as the "Rollem Slip Stream" machine, and more particularly to a device and method for conveniently adjusting the relative locations or "timing" of a pair of notches in the lower blades of a first stage slitter assembly relative to leading and trailing edges of an advancing photo sheet.

Sport cards, such as baseball trading cards and the like, are very popular, and several major companies, including the present assignee, compete vigorously in this large market.

In the manufacture of sport cards, a large number of photographs of various individual athletes are printed on each of many large, single sheets of suitable paper (herein referred to as "photo sheets"). Each large photo sheet then is slit, first "horizontally" and then "vertically", to form a group or collection of individual sport cards which then are collated and packaged.

To this end, the sport card industry has used a card slitting machine called the "Rollem Slip Stream machine". The standard Rollem Slip Stream machine includes a first stage slitting assembly that is manufactured by Rollem, and is shown in FIG. 1. Various aspects of the Rollem Slip Stream machine are disclosed in U.S. Pat. No. 4,405,121 by Hill, issued Sep. 20, 1983 entitled "Cutting and Collating Sheets of Paper Cards, etc.", and incorporated herein by reference.

FIG. 1 herein shows a top view diagram of the Rollem Slip Stream machine 1. A large (typically 28 inches by 40 inches) photo sheet 40 is advanced along a first section 6, as indicated by arrow 3. A first stage slitting assembly 2 includes a lower blade assembly 15, 19 and an upper blade assembly 10, 18, as shown in FIG. 3. The prior art Rollem first stage slitting assembly 2 makes "interrupted cut" slits such as 41 in photo sheet 40, as shown in FIGS. 2 and 2A. The "interrupted cut" slits 41 are necessary to provide a leading edge margin 42A and a trailing edge margin 42B so that photo sheet 40 remains intact, allowing it to be advanced as a unit in direction and then at a right angle thereto in direction 5, to a second stage slitting assembly 14 and then, after the "horizontal" interrupted cut slits 41 are made, into a second section 7. In first stage slitting assembly 2, a number of individual "interrupted cut" slits 41 are made, each of which extends to within approximately ½ inch of the opposed leading and trailing edges of photo sheet 40, leaving leading and trailing edge margins 42A and 42B, respectively, that maintain "horizontally" slit photo sheet 40 intact so further advancing and "vertical" slitting of the entire photo sheet 40 is possible. The second stage slitting assembly 14 cuts a second set of "vertical" slits (not shown) that are perpendicular to the "horizontal" interrupted cut slits 41.

Referring to FIG. 3, the prior art Rollem Slip Stream first stage slitting assembly 2 includes a number of upper hub/blade assemblies 18 mounted on a single gear-driven upper shaft 10. Each hub/blade assembly 18 includes a thin, circular upper blade 12 secured by set screws (not shown) to a planar face of an upper hub 11. Set screws (not shown) secure the various upper hubs 11 to shaft 10, which is journaled in several stationary bearing assemblies (not shown).

Numeral 19 designates lower hub/blade assemblies of the standard Rollem first stage slitting assembly 2. Each lower hub/blade assembly 19 includes a thin circular blade 17 mounted on a hub 16, which in turn is mounted on a common gear-driven lower shaft 15. The drive of lower shaft 15 is "synchronized" with the drive of upper shaft 10 so that the cutting edge velocity of upper blade 12 is precisely the same as that of lower blade 17. As shown in FIGS. 3 and 4, the lower portion of each upper blade 12 and the upper portion of each lower blade 17 make contact in a "blade overlap" area. The upper blades 12 are urged against the corresponding lower blades 17 in the blade overlap area, as indicated by arrow 25 in FIG. 3. A sheet feeder 35 advances the leading edge of photo sheet 40 in the direction of arrow 34 in FIG. 4 in synchronization with the arrival of leading notch 17-1 in each of the lower blades 17 at the blade overlap area to determine the location of the leading end of each interrupted cut slit 41. When the trailing notch 17-2 of each lower blade 17 later arrives at the blade overlap area, it determines the location of the trailing end of each interrupted cut slit 41.

As shown in FIG. 3, a resilient 0-ring 30 is disposed in a mating groove in each of upper hubs 11. As photo sheet 40 is advanced between the upper hubs 11 and lower hubs 16, resilient O-ring 30 frictionally contacts the upper surface of photo sheet 40 and aids in advancing it between the upper and lower slitter blades 12 and 17. If the upper surface of photo sheet 40 is slippery because of the type of finish thereon, some slippage will occur between O-rings 30 and the upper surface of photo sheet 40.

To produce the above-mentioned "interrupted cut" slits 41, lower blades 17 each have two spaced "timing notches" 17-1 and 17-2, as shown in FIG. 4. The length of arc 45 between point A of leading timing notch 17-1 and point B of trailing timing notch 17-2 is equal to the length of an "interrupted cut" slit 41 if there is no slippage of photo sheet 40 relative to lower blade 17. The feeding of photo sheet 40 is synchronized to the times at which timing notches 17-1 and 17-2 meet upper blade 12 to produce the leading half inch margin 42A and the trailing half inch margin 42B (FIG. 2) that keep photo sheet 40 intact after the horizontal "interrupted cut" slits 41 are made.

In order that timing notches 17-1 and 17-2 become aligned with leading and trailing edge portions, respectively, of photo sheet 40 at exactly the right times, the rotation, i.e., "timing", of upper blades 12 and lower blades 17 must be precisely coordinated with the advancement of photo sheet 40. A major problem that has arisen in use of the standard Rollem Slip Stream machine is that the photo sheets 40 are frequently formed on photo paper sheets of various thicknesses, kinds of paper, and surface finishes. It has been found that such variation in thickness and kind of photo paper and the differences in "slipperiness" of the various finishes result in different amounts of slippage of photo sheet 40 with respect to the mechanism 35 which advances it in the direction of arrow 34. This disturbs the relative position or "timing" between notches 17-1 and 17-2 and the leading and trailing edges of photo sheet 40.

In order to accurately slit photo sheets of different thicknesses, kinds of material, and/or surface finishes, it has been necessary to shut down the Rollem Slip Stream machine 1, loosen a chain-driven drive clamp located on the upper drive shaft, manually advance or retard the lower notched blade in order to advance or retard the timing notches thereon, re-tighten the drive clamp, and test the results by starting up the Rollem Slip Stream machine and running a photo sheet through it. Typically, several attempts have been required to obtain the correct notch timing. This has been a very labor-intensive, time-consuming, and expensive procedure.

Consequently, there is an unmet need for a practical, economical solution to the above problems associated with varying amounts of slippage of photo sheets of various thicknesses, various kinds of paper, and various surface finishes, and especially to avoid the need to shut down operation of the Rollem Slip Stream machine and perform the time-consuming foregoing timing adjustment process.

SUMMARY OF THE INVENTION

Accordingly, it is an object of the invention to provide a mechanism and technique for easily adjusting the timing of the notches on the lower slitting blades of a Rollem Slip Stream machine and the leading relative to trailing edges of an advancing photo sheet.

It is another object of the invention to provide an apparatus and technique to compensate for variations in slippage of an advancing photo sheet as it passes through the first slitter stage of a Rollem Slip Stream machine due to variations in properties of various photo sheets.

Briefly described, and in accordance with one embodiment thereof, the invention provides an improvement in a slitting machine which includes a first slitting stage adapted to produce a plurality of "interrupted cut" slits in an advancing sheet having a leading edge and a trailing edge. The first slitting stage includes a lower shaft, a plurality of cylindrical lower hubs rigidly mounted on the lower shaft, and a plurality of notched lower blades rigidly attached to the lower hubs, respectively. The first slitting stage also includes an upper shaft, a plurality of cylindrical upper hubs mounted on the upper shaft, and a plurality of upper blades attached to the upper hubs, respectively, wherein an edge portion of each rotating upper blade overlaps and engages an edge portion of a corresponding rotating lower blade to make the interrupted cut slits. A sheet feeder advances the sheet between the rotating lower blades and the upper blades. The improvement includes the combination of a drive pulley, a driven pulley, a fixed-length belt engaging the drive pulley and the driven pulley and defining a "power path" between the drive pulley and the driven pulley and a "return path" between the drive pulley and the driven pulley, a mechanism translating rotation of the driven pulley to drive the upper shaft and lower shaft in synchronization with the advancing of the sheet by the sheet feeder, a moveable idle pulley engaging a portion of the belt in the power path, an adjustment mechanism for moving the moveable idle pulley to adjust the length of the power path, and a tensioning mechanism engaging a portion of the belt in the return path to maintain tension of the portion of the belt in the return path as the length of the return path varies in response to the adjustment of the length of the power path. The location of the notches of the lower blade relative to the sheet being advanced by the sheet feeder therefore can be easily adjusted to adjust the margins between ends of the interrupted cut slits and the leading and trailing edges of the advancing sheet so as to compensate for varying amounts of slippage of various kinds of photo sheets as they are advanced through the first slitting stage.

DETAILED DESCRIPTION OF THE PREFERRED EMBODIMENTS

Figure 4:
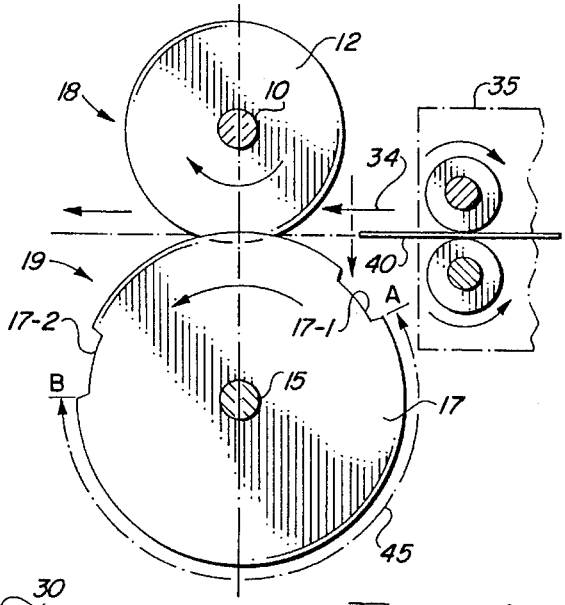
FIG. 4 (PRIOR ART)
FIG. 4 is an end view diagram illustrating notches in a lower slitting blade synchronized with a sheet advancing mechanism to determine the locations and lengths of interrupted cut slits made by the prior art interrupted cut slitting machine of FIGS. 1 and 3.
Figure 3:
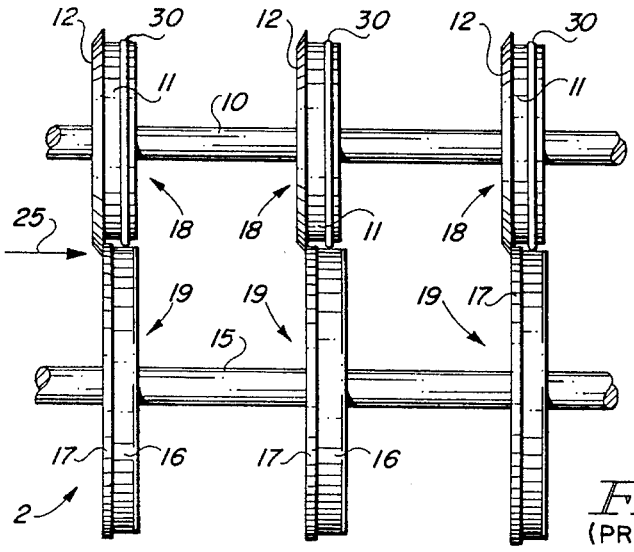
FIG. 3 (PRIOR ART)
FIG. 3 is an elevational view diagram of the exit side of the prior art first stage slitting assembly in FIG. 1.

The present invention provides a way of solving the above described problems of the prior art by adjusting the effective length of a notched timing belt associated with the drive system that rotates the upper shaft 10 and the lower shaft 15 shown in FIGS. 3 and 4. Before describing the present invention, however, it will be helpful to understand the slitter blade drive assembly of the prior art Rollem Slip Stream machine. This drive assembly is shown in FIG. 5.

Figure 5:
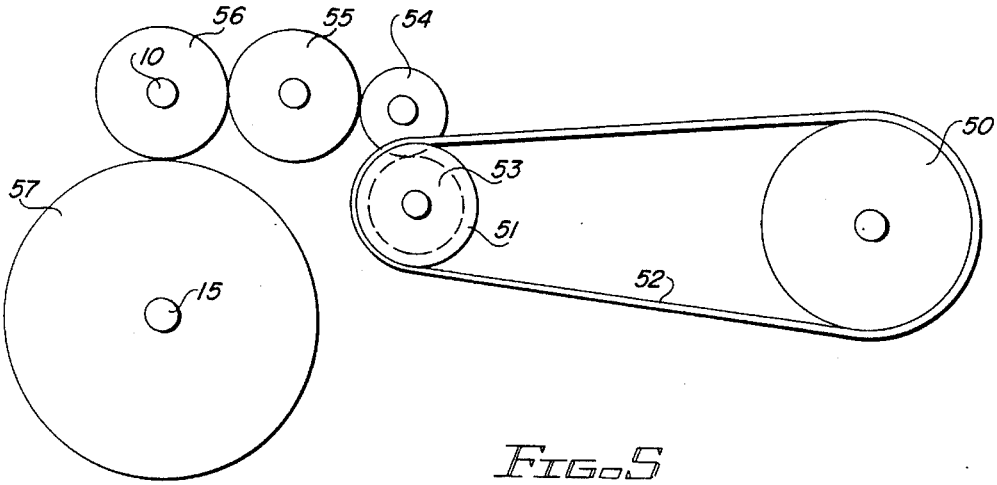
FIG. 5 (PRIOR ART)
FIG. 5 is an elevational front view diagram illustrating the known upper and lower slitter blade pulley/belt/gear drive arrangement of the prior art slitting machine of FIG. 1.

Referring to FIG. 5, the closest prior art arrangement for driving upper shaft 10 and lower shaft 15 includes a main drive timing pulley 50, which has precisely spaced notches that mesh with a correspondingly notched, fixed-length timing belt 52. Timing belt 52 drives a notched "driven pulley" or timing pulley 51, which is mounted on a common shaft with a gear 53. Gear 53 drives gear 54, which in turn drives gear 55. Gear 55 drives gear 56, which is mounted on one end of the same upper shaft 10 that carries the upper hubs 11 and blades 12. Gear 56 drives gear 57, which drives the same lower shaft 15 on which lower hubs 16 and blades 17 are mounted. (It should be appreciated that suitable sprockets and chains could be used instead of timing pulleys and a notched timing belt.)

Figure 1:
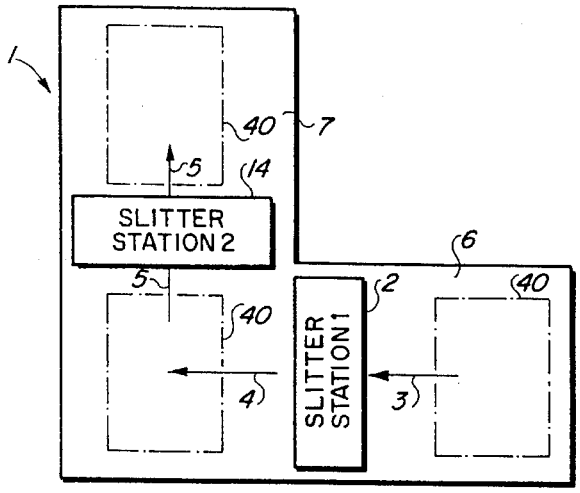
FIG. 1 (PRIOR ART)
FIG. 1 is a top view diagram illustrating the general directions of movement of a photo sheet through a prior art "interrupted cut" slitting machine.
Figure 2:
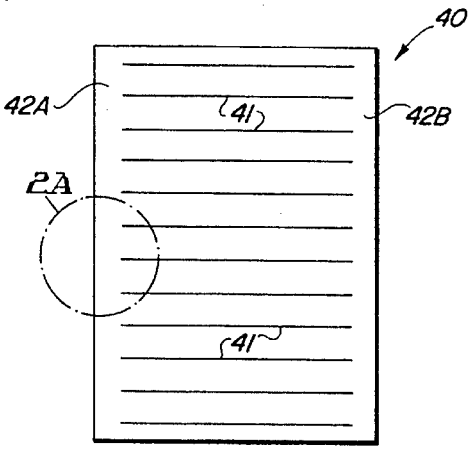
FIG. 2 is a diagram illustrating "interrupted cut" slits in a photo sheet to be slit into individual sport card photographs.
Figure 2A:
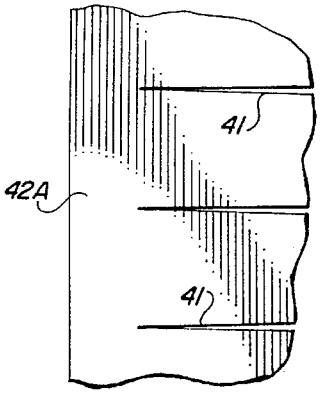
FIG. 2A is an enlarged view of detail 2A of FIG. 2.

It can be seen that the prior art arrangement of FIG. 5 provides a fixed relationship between the rotation of main drive pulley 50 and the rotation of upper blades 12 and lower blades 17. This arrangement does not allow convenient adjustment of the location or "timing" of notches 17-1 and 17-2 in rotating lower blades 17 with respect to the locations or "timing" of the leading and trailing edges of the advancing photo sheet 40. Slippage of advancing sheet 40 therefore can result in elimination of either the leading edge margin 42A or the trailing edge margin 42B of advancing photo sheet 40. This would make it impossible for advancing photo sheet 40 to remain sufficiently intact as it exits from the first slitter station 2 as indicated by arrow 4 in FIG. 1 and moves through the second stage slitter 14, to ensure accuracy of the transverse cuts made by second stage slitter 14 (FIG. 1).

Figure 6:
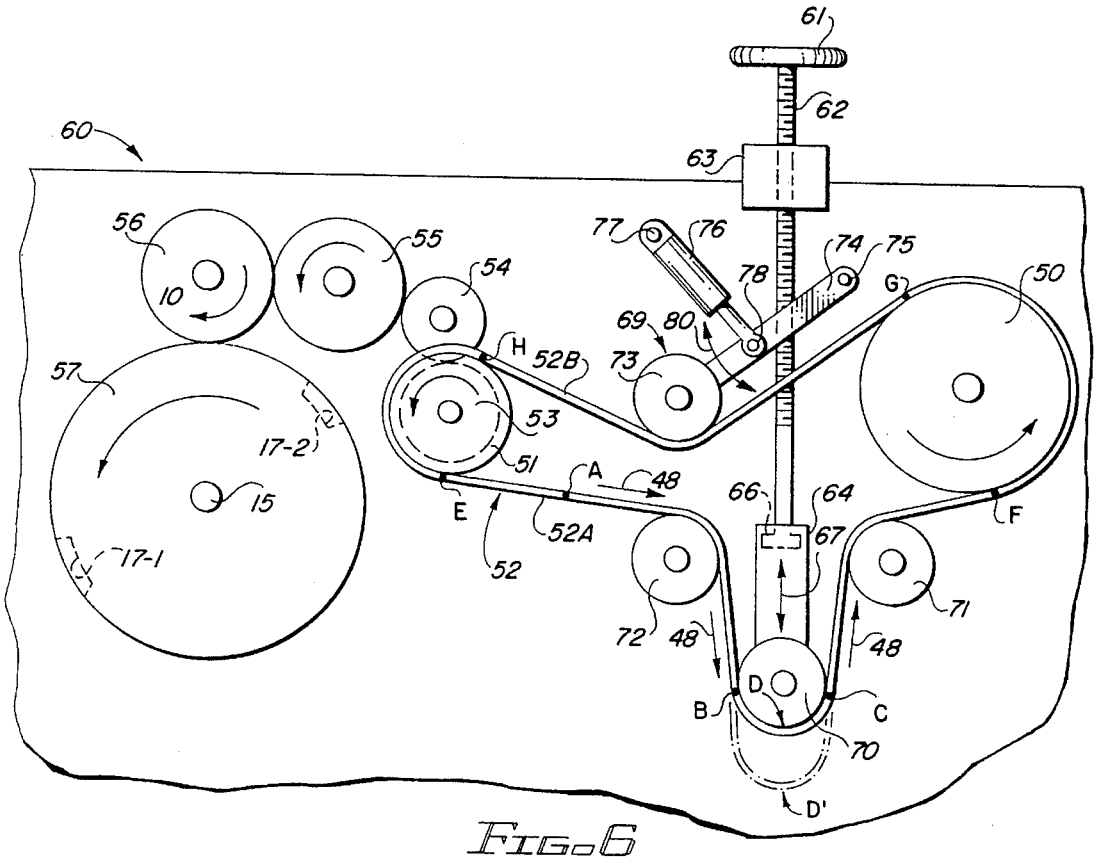
FIG. 6 is an elevational front view diagram of the notch "timing" adjustment assembly of the present invention.

Referring now to the embodiment of the invention shown in FIG. 6, a support frame 60 of the Rollem slitting machine 1 supports the upper and lower slitter assemblies 18 and 19 of FIGS. 3 and 4, the shafts 10 and 15, and also the sheet feeder advancing mechanism (not shown). All of the components shown in the prior art drive arrangement of FIG. 5 except timing belt 52 are also present in the drive arrangement of FIG. 6.

In FIG. 6, the new combination of elements includes a belt tensioner 69, two idle pulleys 71 and 72, a vertically moveable idle pulley 70 the position of which is vertically adjustable in either of the directions of arrow 67, by simply turning a "notch timing adjustment" handle 61, and a longer timing belt 52A arranged as illustrated.

More specifically, timing belt 52A loops around "drive" timing pulley 50, "driven" timing pulley 51, the upper surface of idle pulley 72, the lower surface of vertically moveable idle pulley 70, and the upper surface of idle pulley 71. The portion 52A of timing belt 52 extending between point E at which timing belt 52 departs from driven pulley 51, around idle pulley 72, moveable idle pulley 70, and idle pulley 71 to point F is referred to herein as the "power path" because rotation of drive pulley 50 in the indicated direction produces enough tension in portion 52A of timing belt 52 to rotate driven pulley 51 by applying power to it. The portion 52B of belt 50 extending from point G of drive pulley 50 to point H of driven pulley 51 is referred to herein as the "return path".

Notch timing adjustment handle 61 is connected to a vertical threaded shaft 62 which extends through a threaded stationary nut block 63 and extends down to a vertically moveable pulley mounting block 64. A suitable "captured nut" or comparable structure 66 at the lower end of shaft 62 causes vertical movement of pulley mounting block 64 by the vertical movement of threaded shaft 62 as notch timing adjustment handle 61 is rotated. Moveable idle pulley 70 is rotatably mounted on pulley mounting block 64.

Belt tensioner 69 includes an air cylinder 76 anchored at one end 77 to frame 60 and having a moveable member pivotally connected to a mid-portion of an arm 74, and maintains a tensile force of approximately 15 pounds in timing belt 52 regardless of where moveable pulley 70 is vertically adjusted within its range. As notch timing adjustment handle 61 is rotated, thereby adjusting moveable idle pulley 70 up or down, arm 74 of air cylinder 76 pivots to allow tensioner idle pulley 73 to accommodate this change.

In accordance with the present invention, vertical adjustment of idle pulley 70 in response to rotating of notch timing adjustment handle 61 results in an effective lengthening or shortening of the power path portion 52A of belt 52 between main drive pulley 50 and driven pulley 51.

If the total length of the portion of belt 52 in power path 52A is constant, then the amount of time required for an arbitrary point A of belt 52 moving in the direction of arrows 48 from point E at which belt 52 departs from driven pulley 51 to point F at which belt 52 meets drive pulley 50 clearly is also constant. The rotation of lower slitter blade timing notches 17-1 and 17-2 is synchronized in a fixed predetermined fashion with advancement of photo sheet 40, because both photo sheet 40 and notches 17-2 are moved in synchronization with main drive pulley 50.

If the length of the portion of timing belt 52 in power path 52A changes as a result of turning notch timing adjustment handle 61, then the amount of time required for a point A of timing belt 52 to move from point E (where timing belt 52 departs from driven pulley 51) to point F (where timing belt 52 joins drive pulley 50) also changes. For example, if notch timing adjustment handle 61 is rotated to lower mounting block 64 and moveable idle pulley 70 so that timing belt 52 passes through the path indicated by dotted lines D', then the length of the power path 52A is increased by the difference between the length of the arc through the path B, D, C and the length of the arc through the path B, D', C. Consequently, the "phase" or timing of notches 17-1 and 17-2 relative to the leading and trailing edges of the advancing photo sheet 40 is adjusted proportionately.

This effectively advances or retards the relative positions of notches 17-1 and 17-2 of lower blades 17 relative to the leading and trailing edges, respectively, of advancing photo sheet 40.

It has been found that for any particular type of photo paper and a particular surface finish thereof, the amount of slippage of photo sheet 40 as it is advanced between the upper slitter blades 12 and lower slitter blades 17 is essentially constant. Therefore, that amount of slippage can be easily compensated for by simply turning notch timing adjustment handle 61 until the leading and trailing edge margins of photo sheet 40 are equally balanced. The need to shut down the entire card slitting machine and make the above described drive clamp adjustments to balance such leading and trailing edge margins of photo sheet 40 has been avoided.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, pairs of closely spaced upper blades 12 and corresponding pairs of closely spaced lower blades 17 could be provided to make narrow "galley cuts" approximately one fourth of an inch apart to thereby cut out quarter inch wide strips between the various rows or columns of photos in photo sheet 40 could be provided for example in the manner disclosed in my co-pending commonly assigned patent application "Floating Blade Slitting Device and Method", Ser. No. 08/194,045, filed Feb. 9, 1994, and incorporated herein by reference.

What is claimed is:

1. In a slitting machine including a first slitting stage for producing a plurality of interrupted cut slits in an advancing sheet having a leading edge and a trailing edge, wherein the first slitting stage includes i. a lower shaft, a plurality of cylindrical lower hubs rigidly mounted on the lower shaft, and a plurality of circular notched lower blades rigidly attached to the lower hubs, respectively, ii. an upper shaft, a plurality of cylindrical upper hubs mounted on the upper shaft, and a plurality of circular upper blades attached to the upper hubs, respectively, an edge portion of each upper blade overlapping and engaging an edge portion of a corresponding lower blade to cut the interrupted cut slits, the slitting machine also including a sheet feeder adapted to advance the sheet between the lower blades and the upper blades in synchronization with rotation of the lower blades, and a mechanism translating rotation of a driven pulley to drive the lower shaft in synchronization with the advancing of the sheet by the sheet feeder, the improvement comprising in combination:

(a) a drive pulley, and a fixed-length belt driven by the drive pulley and driving the driven pulley, the belt providing a power path between the drive pulley and the driven pulley and also providing a return path between the drive pulley and the driven pulley;

(b) a moveable idle pulley engaging a portion of the belt in the power path;

(c) an adjustment mechanism for moving the moveable idle pulley to adjust the length of the power path; and (d) a tensioning mechanism engaging a portion of the belt in the return path to maintain tension of the belt in the return path as the length of the return path varies to compensate for adjustment of the length of the power path, whereby the locations of the notches of each lower blade as it rotates relative to the locations of the sheet as it is advanced by the sheet feeder are varied to adjust margins between the ends of the interrupted cut slits and the leading and trailing edges of the sheet.

2. In a slitting machine, the improvement as recited in claim 1, wherein the rotation translating mechanism translates rotation of the driven pulley to drive the upper shaft in synchronization with the lower shaft, and wherein the slitting machine further includes a resilient band circumferentially disposed on each upper hub, respectively, to frictionally engage an upper surface of the sheet to advance the sheet between cylindrical surfaces of the upper hubs and lower hubs as the sheet is being slit.

3. In a slitting machine, the improvement as recited in claim 2 wherein the sheet is composed of paper, an upper surface of which frictionally engages the resilient bands.

4. In a slitting machine, the improvement as recited in claim 3 wherein each lower blade includes first and second notches, and the sheet has a finish on at least one of its upper and lower surfaces which may cause or contribute to slippage of the sheet as it advances relative to the locations of first and second notches of the lower blades as they rotate.

5. In a slitting machine, the improvement as recited in claim 4 wherein the upper blades and lower blades are disk-shaped and are relatively thin compared to the upper and lower hubs, the first and second notches of each lower blade being spaced apart on the periphery of that lower blade by a peripheral distance that equals the length of each intended interrupt cut slit plus an amount corresponding to the slippage.

6. In a slitting machine, the improvement as recited in claim 1 and further including a first stationary idle pulley engaging a portion of the belt in the power path and located adjacent to a first side of the moveable idle pulley, and a second stationary idle pulley engaging another portion of the belt in the power path located adjacent to a second side of the moveable idle pulley, so that changes in the length of the power path caused by adjustment of the location of the moveable idle pulley are directly proportional to the amount of movement of the location of the moveable idle pulley caused by the adjustment.

7. In a slitting machine, the improvement as recited in claim 6 wherein the adjustment mechanism includes an elongated screw shaft extending through a stationary nut block and connected to a moveable mount rotatably supporting the moveable idle pulley, and also includes a control element for turning the screw shaft to adjust the length of the power path.

8. In a slitting machine, the improvement as recited in claim 7 wherein the tensioning mechanism includes an idle pulley pressing against a portion of the belt in the return path with a predetermined force.

9. In a slitting machine including a first slitting stage for producing a plurality of interrupted cut slits in an advancing sheet having a leading edge and a trailing edge, wherein the first slitting stage includes i. a lower shaft, a plurality of cylindrical lower hubs rigidly mounted on the lower shaft, and a plurality of circular notched lower blades rigidly attached to the lower hubs, respectively, ii. an upper shaft, a plurality of cylindrical upper hubs mounted on the upper shaft, and a plurality of circular upper blades attached to the upper hubs, respectively, an edge portion of each upper blade overlapping and engaging an edge portion of a corresponding lower blade to cut the interrupted cut slits, the slitting machine also including a sheet feeder adapted to advance the sheet between the lower blades and the upper blades in synchronization with rotation of the lower blades, and a mechanism translating rotation of a driven sprocket to drive the lower shaft in synchronization with the advancing of the sheet by the sheet feeder, the improvement comprising in combination:

(a) a drive sprocket, and a fixed-length chain driven by the drive sprocket and driving the driven sprocket and providing a power path between the drive sprocket and the driven sprocket and also providing a return path between the drive sprocket and the driven sprocket;

(b) a moveable idle sprocket engaging a portion of the chain in the power path;

(c) an adjustment mechanism for moving the moveable idle sprocket to adjust the length of the power path; and (d) a tensioning mechanism engaging a portion of the chain in the return path to maintain tension of the chain in the return path as the length of the return path varies to compensate for the adjustment of the length of the power path, whereby the locations of the notches of each lower blade as it rotates relative to the location of the sheet as it is advanced by the sheet feeder are varied to adjust margins between the ends of the interrupted cut slits and the leading and trailing edges of the sheet.

10. A slitting machine for producing a plurality of interrupted cut slits in an advancing sheet having a leading edge and a trailing edge, comprising in combination:

(a) a lower shaft, a plurality of lower hubs rigidly mounted on the lower shaft, and a plurality of circular notched lower blades rigidly attached to the lower hubs, respectively;

(b) an upper shaft, a plurality of upper hubs mounted on the upper shaft, and a plurality of circular upper blades attached to the upper hubs, respectively, an edge portion of each upper blade overlapping and engaging an edge portion of a corresponding lower blade to cut the interrupted cut slits;

(c) a sheet feeder adapted to advance the sheet between the lower blades and the upper blades;

(d) a drive pulley, and a fixed-length belt driven by the drive pulley and driving a driven pulley, the belt providing a power path between the drive pulley and the driven pulley and also providing a return path between the drive pulley and the driven pulley;

(e) a mechanism translating rotation of the driven pulley to drive the lower shaft and upper shaft in synchronization with the advancing of the sheet by the sheet feeder;

(f) an adjustment mechanism adapted to adjust the length of the power path; and (g) a tensioning mechanism engaging a portion of the belt in the return path to maintain tension of the belt in the return path as the length of the return path varies to compensate for adjustment of the length of the power path, whereby the locations of the notches of each lower blade as it rotates relative to the locations of the sheet as it is advanced by the sheet feeder are varied to adjust margins between the ends of the interrupted cut slits and the leading and trailing edges of the sheet.

11. The slitting machine of claim 10 wherein the drive pulley is a sprocket, the driven pulley is a sprocket, and the belt is a chain.

12. A method of operating a slitting machine for producing a plurality of interrupted of cut slits in an advancing sheet having a leading edge and a trailing edge, the method comprising the steps of:

(a) providing a lower shaft, a plurality of lower hubs rigidly mounted on the lower shaft, and a plurality of circular notched lower blades rigidly attached to the lower hubs, respectively, and also providing an upper shaft, a plurality of upper hubs mounted on the upper shaft, and a plurality of circular upper blades attached to the upper hubs, respectively, so that an edge portion of each upper blade overlaps and engages an edge portion of a corresponding lower blade to cut the interrupted cut slits;

(b) advancing the sheets by means of a sheet feeder;

(c) rotating a driven pulley in synchronization with the advancing of the sheet by means of a fixed-length belt driven by a drive pulley, the belt providing a power path between the drive pulley and the driven pulley and also providing a return path between the drive pulley and the driven pulley; and (d) adjusting the length of the power path to thereby adjust the locations of the notches of the lower blades as they rotate relative to the locations of the sheet as it is advanced by the sheet feeder and thereby adjust margins between ends of the interrupted cut slits and the leading and trailing edges of the sheet.

13. The method of claim 12 including maintaining a predetermined tension in a portion of the belt in the return path.

14. The method of claim 13 including operating the sheet feeder in response to rotation of the drive pulley to accomplish the synchronization of the driven pulley with the advancing sheet.

15. A method of operating a slitting machine for producing a plurality of interrupted of cut slits in an advancing sheet having a leading edge and a trailing edge, the method comprising the steps of:

(a) providing a lower shaft, a plurality of lower hubs rigidly mounted on the lower shaft, and a plurality of circular notched lower blades rigidly attached to the lower hubs, respectively, and also providing an upper shaft, a plurality of upper hubs mounted on the upper shaft, and a plurality of circular upper blades attached to the upper hubs, respectively, so that an edge portion of each upper blade overlaps and engages an edge portion of a corresponding lower blade to cut the interrupted cut slits;

(b) advancing the sheets by means of a sheet feeder;

(c) rotating a driven sprocket in synchronization with the advancing of the sheet by means of a fixed-length chain driven by a drive sprocket, the chain providing a power path between the drive sprocket and the driven sprocket and also providing a return path between the drive sprocket and the driven sprocket; and (d) adjusting the length of the power path to thereby adjust the locations of the notches of the lower blades as they rotate relative to the locations of the sheet as it is advanced by the sheet feeder and thereby adjust margins between ends of the interrupted cut slits and the leading and trailing edges of the sheet.

* * * * *